US009454176B2

(12) United States Patent
Kim et al.

(10) Patent No.: US 9,454,176 B2
(45) Date of Patent: Sep. 27, 2016

(54) PEDAL OPERATING APPARATUS OF VEHICLE

(71) Applicants: HYUNDAI MOTOR COMPANY, Seoul (KR); KYUNG CHANG INDUSTRIAL CO., LTD., Daegu (KR)

(72) Inventors: Eun Sik Kim, Gwangmyeong-Si (KR); Jong Hee Han, Gyeongsangbuk-Do (KR)

(73) Assignees: HYUNDAI MOTOR COMPANY, Seoul (KR); KYUNG CHANG INDUSTRIAL CO., LTD., Daegu (KR)

( * ) Notice: Subject to any disclaimer, the term of this patent is extended or adjusted under 35 U.S.C. 154(b) by 0 days.

(21) Appl. No.: 14/720,727

(22) Filed: May 22, 2015

(65) Prior Publication Data

US 2016/0160965 A1 Jun. 9, 2016

(30) Foreign Application Priority Data

Dec. 3, 2014 (KR) ..... 10-2014-0172253

(51) Int. Cl.
*G05G 1/30* (2008.04)
*G05G 1/46* (2008.04)

(52) U.S. Cl.
CPC . *G05G 1/30* (2013.01); *G05G 1/46* (2013.01)

(58) Field of Classification Search
CPC ..... G05G 1/30; G05G 1/40; G05G 1/405; G05G 1/44; G05G 1/445; G05G 1/46; B60K 26/021; B60T 7/06
See application file for complete search history.

(56) References Cited

U.S. PATENT DOCUMENTS

| | | | | |
|---|---|---|---|---|
| 7,497,144 | B2 | 3/2009 | Yoon | |
| 7,568,407 | B2 | 8/2009 | Kim et al. | |
| 7,614,320 | B2 * | 11/2009 | Fukase | B60T 7/06 74/512 |
| 7,735,393 | B2 | 6/2010 | Fukase | |
| 9,304,529 | B2 * | 4/2016 | Kim | G05G 1/44 |
| 9,323,282 | B2 * | 4/2016 | Min | G05G 1/44 |
| 2005/0103151 | A1 | 5/2005 | Yoon | |
| 2005/0104447 | A1 * | 5/2005 | Okuma | B60K 23/02 303/158 |

(Continued)

FOREIGN PATENT DOCUMENTS

| | | | | |
|---|---|---|---|---|
| FR | 2967270 | A1 * | 5/2012 | G05G 1/30 |
| JP | 04-216113 | A | 8/1992 | |

(Continued)

OTHER PUBLICATIONS

Korean Notice of Allowance dated Mar. 2, 2016 issued in corresponding Korean patent application No. 10-2014-0172253.

*Primary Examiner* — Adam D Rogers
(74) *Attorney, Agent, or Firm* — McDermott Will & Emery LLP

(57) ABSTRACT

A pedal operating apparatus for a vehicle includes a pedal member fixed to a vehicle body panel, having a hinge shaft provided at a back end thereof, and having a height controller above the hinge shaft. A pedal arm has an upper end rotatably installed at the hinge shaft of the pedal member, the upper end being provided with a protrusion protruding forward. A pedal effort controller is configured to include an elastic member rotatably installed at a front portion of the pedal arm. A switching member extends and is bent downwardly from the elastic member. The switching member has the bent portion contacted to the height controller. The pedal effort controller presses the protrusion downwardly through the switching member with an elastic force at an initial position of the pedal arm, and pushes the protrusion upward.

11 Claims, 10 Drawing Sheets

(56) References Cited

U.S. PATENT DOCUMENTS

| | | | |
|---|---|---|---|
| 2007/0277640 | A1 | 12/2007 | Fukase |
| 2009/0000418 | A1 | 1/2009 | Kim et al. |

FOREIGN PATENT DOCUMENTS

| | | | |
|---|---|---|---|
| JP | 09-315174 | A | 12/1997 |
| JP | 2007-320518 | A | 12/2007 |
| JP | 2014-065456 | A | 4/2014 |
| KR | 10-1998-0046623 | A | 9/1998 |
| KR | 10-2005-0046132 | A | 5/2005 |
| KR | 10-0820241 | B1 | 4/2008 |
| KR | 10-0851323 | B1 | 8/2008 |
| KR | 10-1438964 | B1 | 9/2014 |

* cited by examiner

PEDAL OPERATING APPARATUS OF VEHICLE

CROSS REFERENCE TO RELATED APPLICATION

The present application claims priority to Korean Patent Application No. 10-2014-0172253, filed Dec. 3, 2014, the entire contents of which is incorporated herein by reference for all purposes.

BACKGROUND

1. Technical Field

The present disclosure relates to a pedal operating apparatus for a vehicle, capable of reducing pedal effort o.

2. Description of the Related Art

Generally, a clutch is installed between the flywheel and an input shaft of a transmission to control transfer of power from an engine to the transmission. That is, the clutch serves to cut off the connection between the transmission and engine at the time of first starting the vehicle, or shifting a gear of the transmission and slowly connect the transmission to the engine at the time of moving the vehicle by engine power.

In particular, in the case of a manual transmission, a shift lever needs to be operated so as to prevent the power of the engine from being transferred to the transmission at the time of shifting the gear. To this end, a driver steps on a clutch pedal to control application of the power of the engine to the transmission.

The driver steps on the clutch pedal to prevent the power of the engine from being transferred to the transmission, and then operates the shift lever to shift the gear. Thereafter, when the driver takes his/her foot off the clutch pedal, the clutch pedal returns to its original position by oil pressure from a master cylinder.

Since the driver steps on the clutch pedal with a stronger force than the returning force of the clutch pedal, if the driver drives a vehicle for a long period of time under the driving conditions that he/she needs to frequently shift gears, the driver's leg which is stepping on the clutch may become strained.

The matters described as the related art have been provided only for assisting in the understanding for the background of the present invention and should not be considered as corresponding to the related art known to those skilled in the art.

SUMMARY

An object of the present invention is to provide a pedal operating apparatus for a vehicle, capable of reducing driver's fatigue during pedal use by reducing pedal effort when he/she operates the pedal.

According to an exemplary embodiment of the present invention, there is provided a pedal operating apparatus for a vehicle, including: a pedal member configured to be fixed to a vehicle body panel, have a hinge shaft provided at a back end thereof, and be provided with a height controller above the hinge shaft; a pedal arm configured to have an upper end rotatably installed at the hinge shaft of the pedal member, the upper end being provided with a protrusion protruding forward; and a pedal effort controller configured to include an elastic member rotatably installed at a front portion of the pedal arm in the pedal member and having a length elastically changed and a switching member extending while being bent downwardly from the elastic member to be connected to the protrusion of the pedal arm and having the bent portion contacted to the height controller to be supported thereby, The pedal effort controller presses the protrusion downwardly through the switching member with an elastic force of the elastic member at an initial position of the pedal arm and pushes the protrusion upward by rotating along with the protrusion at the time of rotating the pedal arm.

The protrusion of the pedal arm may protrude upward, forward based on the hinge shaft.

The upper end of the pedal member may be provided with an insertion groove in which the height controller is installed, the height controller may be coupled by penetrating the insertion groove from the upper portion of the pedal member, and the lower end thereof extending downwardly after penetrating the insertion groove may contact the switching member of the pedal effort controller.

The height controller may be configured to have a bolting part which is screw-coupled with the insertion groove and a nut part which fixes the bolting part to the upper end of the pedal member, and the lower end of the bolting part may contact the bent portion of the switching member.

The lower end of the bolting part may be coupled with a pin member which extends horizontally and may surface-contact the bent portion of the switching member.

The insertion groove of the pedal member may be formed to extend forwardly and thus the height control means may be separated forwardly.

The vehicle body panel may be configured with a dash panel and a cowl panel positioned thereon, the pedal member may be installed at the dash panel in the vehicle body panel, and the height controller may be installed at the cowl panel to be coupled with the insertion groove of the pedal member.

The hinge shaft of the pedal arm may be provided with an elastic body which has one end fixed to the pedal member and the other end connected to the back end of the pedal arm to impart the elastic force so as to let the pedal arm rotate forwardly.

The elastic member of the pedal effort control means may be configured to include a first extension rotatably installed to the pedal member and a second extension which elastically moves when inserted into the first extension, and the switching member may be rotatably connected to the second extension and may extend so as to be bent downwardly in an arc shape and then may be rotatably connected to the protrusion of the pedal arm.

The first extension may be formed of a cylinder, the second extension may be formed of a rod moving when inserted into the cylinder, and an elastic spring may be provided to enclose the first extension and the second extension to elastically move the second extension.

As the elastic member is positioned below the hinge shaft of the pedal arm in the pedal member and the switching member is connected to the protrusion of the pedal arm, the pedal effort controller may be positioned above the hinge shaft.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a pedal operating apparatus of a vehicle according to exemplary embodiments of the present invention will be described with reference to the accompanying drawings.

Figure 1:
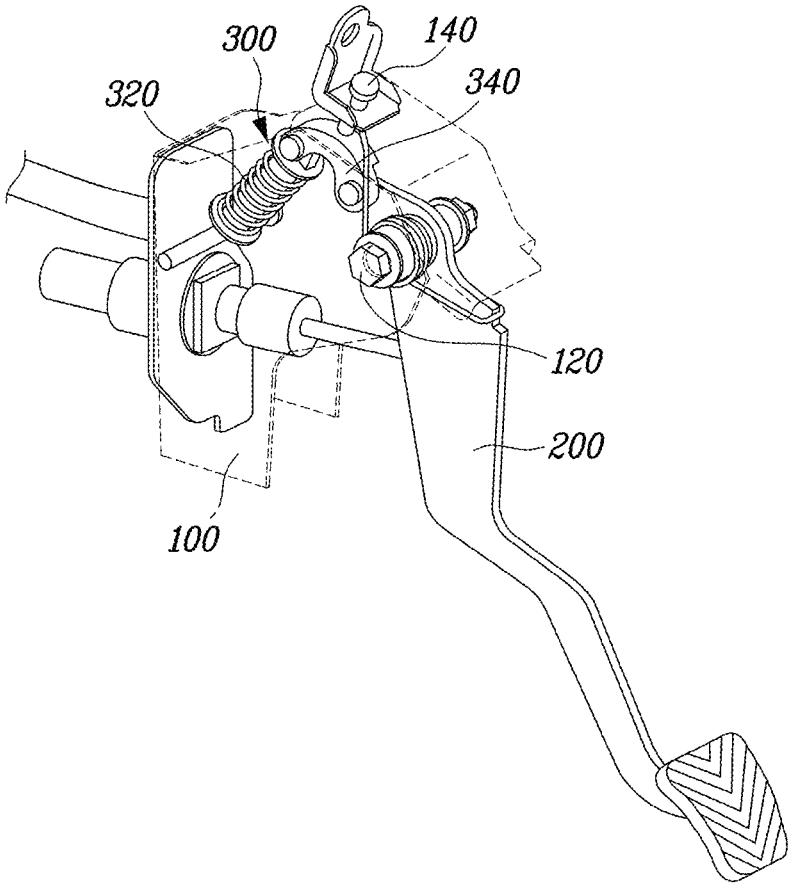
FIG. 1 is a perspective view illustrating a pedal operating apparatus of a vehicle according to an exemplary embodiment of the present invention.
Figure 2:
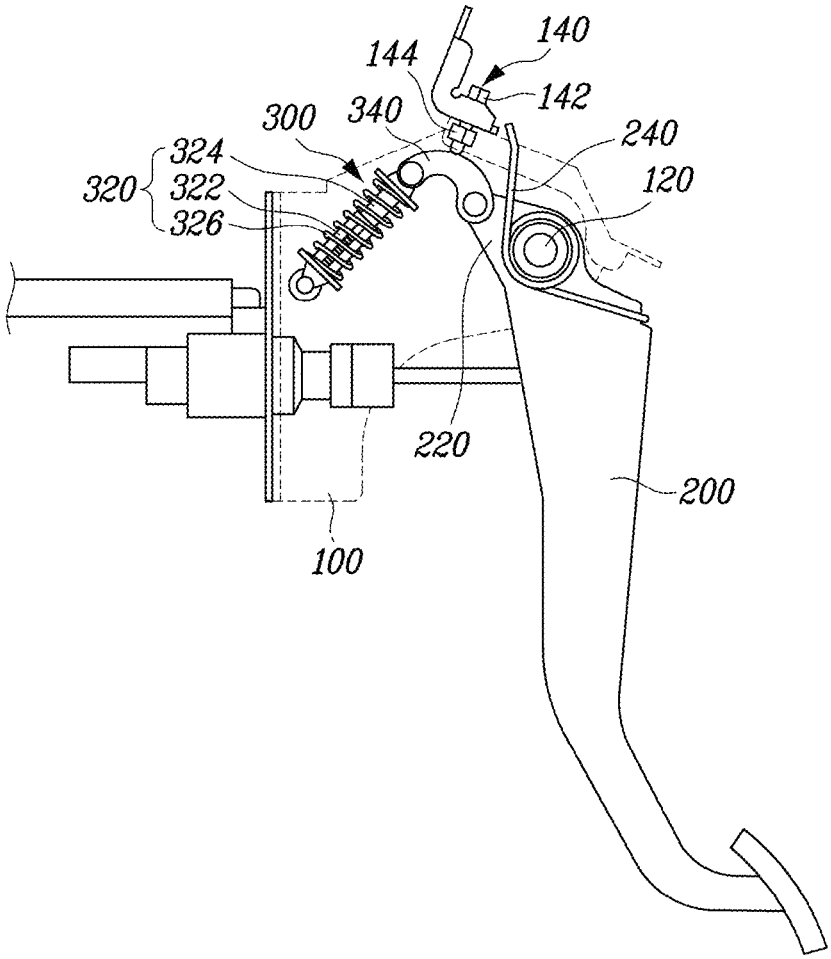
FIG. 2 is a side view illustrating the pedal operating apparatus of a vehicle of FIG. 1.
Figure 3:
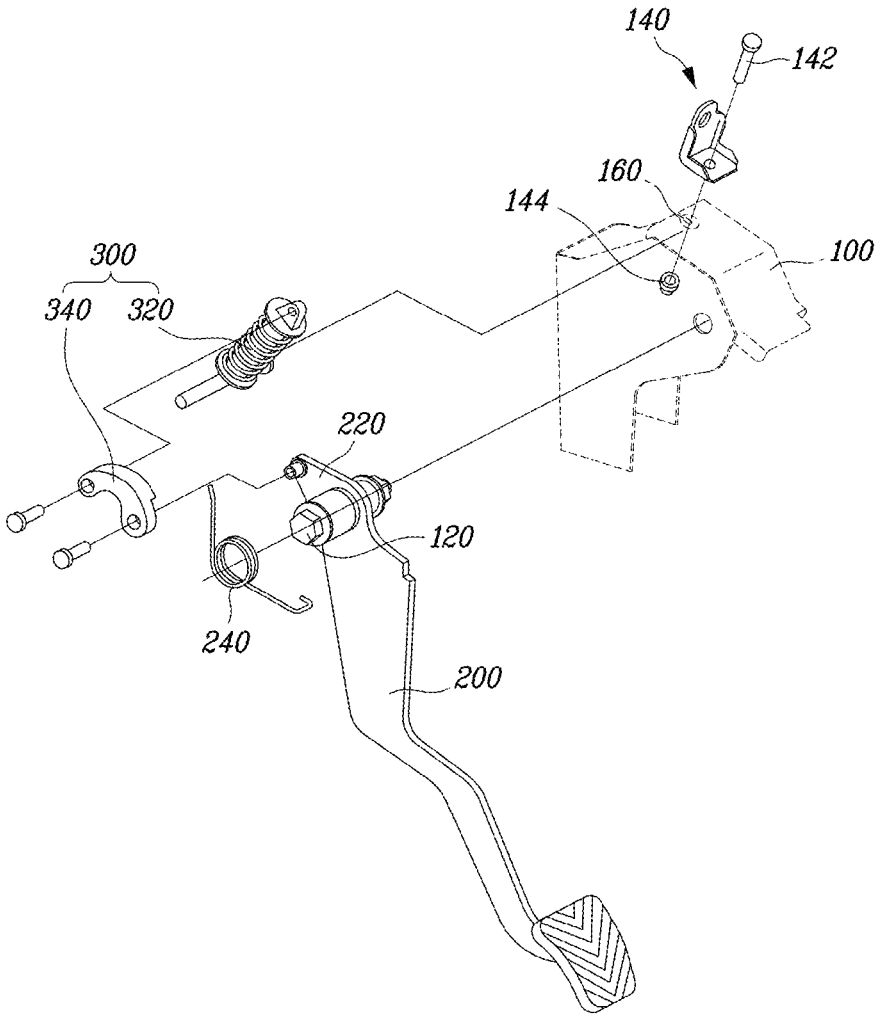
FIG. 3 is an assembling view illustrating the pedal operating apparatus of a vehicle of FIG. 1.

FIG. 1 is a perspective view illustrating a pedal operating apparatus of a vehicle according to an exemplary embodiment of the present invention, FIG. 2 is a side view illustrating the pedal operating apparatus of a vehicle of FIG. 1, FIG. 3 is an assembling view illustrating the pedal operating apparatus of a vehicle of FIG. 1, and FIGS. 4 to 6 are diagrams for describing the pedal operating apparatus of a vehicle of FIG. 1.

In the following description of the present invention, a rotating direction of a pedal by stepping on the pedal is set to be a forward direction and a returning direction of the pedal is set to be a backward direction.

As illustrated in FIGS. 1 to 3, a pedal operating apparatus of a vehicle according to an exemplary embodiment of the present invention includes: a pedal member 100 configured to be fixed to a vehicle body panel 10, have a hinge shaft 120 provided at a back end thereof, and be provided with a height controller 140 above the hinge shaft 120; a pedal arm 200 configured to have an upper end rotatably installed at the hinge shaft 120 of the pedal member 100, in which the upper end is provided with a protrusion 220 protruding forward; and a pedal effort controller 300 configured to include an elastic member 320 rotatably installed at a front portion of the pedal arm 200 in the pedal member 100 and having a length elastically changed, and a switching member 340 extending and being bent downwardly from the elastic member 320 to be connected to the protrusion 220 of the pedal arm 200 and having the bent portion contacting the height controller 140 to be supported thereby, in which the pedal effort controller 300 presses the protrusion 220 downwardly through the switching member 340 with the elastic force of the elastic member 320 at an initial position of the pedal arm 200, and pushes the protrusion 220 upward by rotating along with the protrusion 220 at the time of rotating the pedal arm 200.

That is, according to the exemplary embodiment of the present invention, the upper end of the pedal arm 200 is rotatably installed in the pedal member 100 through the hinge shaft 120 and the pedal effort controller 300 is rotatably installed to be adjacent to the upper end of the pedal arm 200.

In particular, according to the exemplary embodiment of the present invention, the upper end of the pedal arm 200 is provided with the protrusion 220 protruding forwardly and is configured to be connected to the switching member 340 of the pedal effort controller 300. Here, the pedal effort controller 300 is provided with the elastic member 320 rotatably installed at the front portion of the upper end of the pedal arm 200 in the pedal member 100 and is configured to have the length elastically changed. Further, the switching member 340 of the pedal effort controller 300 extends with bent downwardly from the elastic member 320 to be connected to the protrusion 220 of the pedal arm 200, in which the bent portion contacts the height controller 140 provided at the pedal member 100 to be supported thereby.

As a result, as illustrated in FIG. 2, the elastic member 320 of the pedal effort controller 300 is elastically stretched to push the switching member 340 backward. In this configuration, the switching member 340 of the pedal effort controller 300 is formed to be bent downwardly, and upward movement thereof is limited by the height controller 140 provided at the pedal member 100. Thus, the switching member 340 rotates downwardly in the bent direction. As a result, the switching member 340 of the pedal effort controller 300 presses the protrusion 220 of the pedal arm 200 downwardly by the elastic force of the elastic member 320, and a lower end of the pedal arm 200 is applied with a returning force rotating in a backward direction which is an opposite direction thereto based on the hinge shaft 120.

In this state, when the pedal arm 200 rotates by being stepped on, the upper end of the pedal arm 200 rotates based on the hinge shaft 120, and thus the protrusion 220 rotates and the switching member 340 of the pedal effort controller 300 connected to the protrusion 220 rotates together. In this case, the upward movement of the switching member 340 is limited by the height controller 140 and thus rotates downwardly forwardly and presses the elastic member 320. Here, when the pedal arm 200 rotates by a predetermined amount or more, as the pedal effort controller 300 further rotates with it, a direction in which the switching member 340 is bent, lying down, is positioned over the hinge shaft 120 to push the protrusion 220 upwardly with the elastic force of the elastic member 320. As a result, the lower end of the pedal arm 200 is applied with an operating force to rotate forwardly based on the hinge shaft 120.

As such, the pedal effort controller 300 presses the protrusion 220 of the pedal arm 200 at the initial position of the pedal arm 200 to prevent the pedal arm 200 from rotating or provide the returning force, and when the pedal arm 200 is stepped on and thus rotates, the pedal effort controller 300 pushes the protrusion 220 of the pedal arm 200 upward to apply the operating force to enable the pedal arm 200 to rotate forward.

Describing in detail the pedal operating apparatus of a vehicle according to the exemplary embodiment of the present invention to apply the returning force and the operating force to the pedal arm 200, the protrusion 220 of the pedal arm 200 may protrude upward forwardly based on the hinge shaft 120.

As such, the protrusion 220 protrudes upward, forwardly from the upper end of the pedal arm 200, and when the switching member 340 of the pedal effort controller 300 is operated to press the protrusion 220 downwardly or push the protrusion 220 backward, the pedal arm 200 may smoothly rotate based on the hinge shaft 120 in response to the operation.

Figure 4:
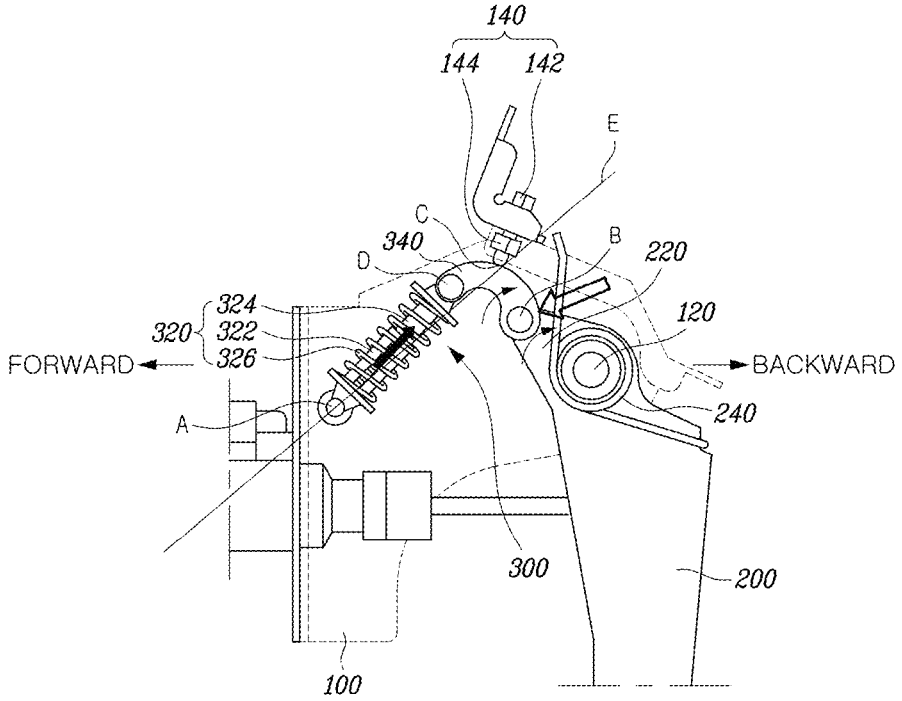
FIGS. 4 to 6 are diagrams for describing the pedal operating apparatus of a vehicle of FIG. 1.
Figure 10:
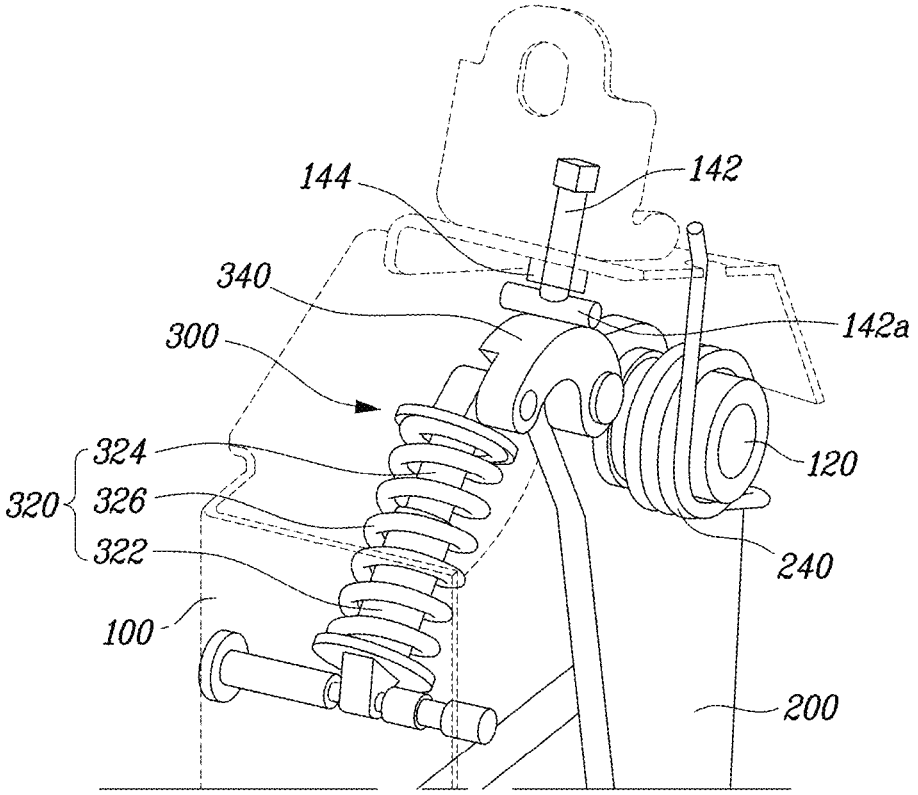
FIG. 10 is a diagram for describing the pedal operating apparatus of a vehicle of FIG. 1.

Meanwhile, as illustrated in FIGS. 4 and 10, the elastic member 320 of the pedal effort controller 300 may be configured to include a first extension 322 which is rotatably installed to the pedal member 100 and a second extension 324 which elastically moves when inserted into the first extension 322.

In this configuration, the first extension 322 is formed of a cylinder, the second extension 324 is formed of a rod moving when inserted into the cylinder, and an elastic spring 326 may be provided to enclose the first extension 322 and the second extension 324 to elastically move the second extension 324.

As such, the elastic member 320 of the pedal effort controller 300 is configured of the first extension 322 which is the cylinder and the second extension 324 which is the rod to move the second extension 324 from the first extension 322, in which the second extension 324 is configured to move by being applied with the elastic force of the elastic spring 326.Thus, when the second extension 324 moves from the first extension 322 by force of the elastic spring 326, the operating force or the returning force is applied to the pedal arm 200.

The switching member 340 connected to the elastic member 320 of the pedal effort controller 300 is rotatably connected to the second extension 324 and extends to be bent downwardly in an arc shape, and then may be rotatably connected to the protrusion 220 of the pedal arm 200. That is, the switching member 340 is configured to move by being pushed as soon as the second extension 324 moves by the elastic spring 326. However, the switching member 340 is formed to be bent downwardly in an arc shape, and an upper surface of the bent portion thereof contacts the height controller 140 to be supported thereby so that the elastic force transferred from the elastic spring 326 is transferred when switched in a downwardly bent direction.

Figure 6:
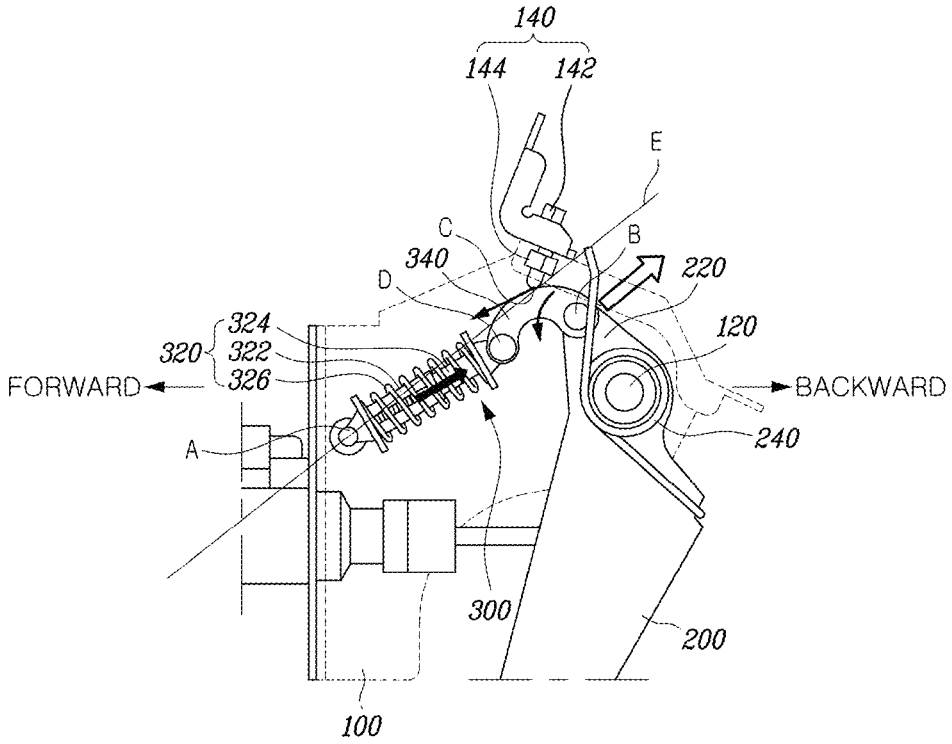

As a result, as illustrated in FIG. 4, the direction of the elastic force transferred backward from the elastic member 320 of the pedal effort controller 300 is switched downwardly, thereby applying the returning force pressing the protrusion 220 of the pedal arm 200. Here, when the pedal arm 200 rotates and thus the switching member 340 of the pedal effort controller 300 rotates together, as illustrated in FIG. 6, the direction of the elastic force being transferred forward as it is, thereby applying the operating force rotating the pedal arm 200 forward.

In more detail, as one end of the elastic member 320 is positioned below the hinge shaft 120 of the pedal arm 200 in the pedal member 100 and the other end of the switching member 340 is connected to the protrusion 220 of the pedal arm 200, the pedal effort controller 300 may be positioned above the hinge shaft 120. Here, the other end of the elastic member 320 and one end of the switching member 340 may be hinged to each other to mutually rotate.

As a result, the switching member 340 of the pedal effort controller 300 is applied with the elastic force of the elastic member 320 in the initial state of the pedal arm 200 to press the protrusion 220 of the pedal arm 200, thereby applying the returning force. As the pedal arm 200 stepwise rotates, the switching member 340 of the pedal effort controller 300 may push the protrusion 220 of the pedal arm 200 forward to apply the operating force.

Describing this with reference to FIGS. 4 to 6, as point A at which the elastic member 320 of the pedal effort controller 300 is installed at the pedal member 100 is positioned below a point B at which the switching member 340 is connected to the protrusion 220 of the pedal arm 200. The switching member 340 is formed to be bent in an arc shape, and the bent portion of the switching member 340 is configured to contact the height controller 140. A point at which the bent portion contacts the height controller 140 is C of the drawing and a point at which the elastic member 320 of the pedal effort controller 300 is connected to the switching member 340 is D.

That is, as illustrated in FIG. 4, at the initial time when the pedal arm 200 does not rotate, the point D at which the elastic member 320 of the pedal effort controller 300 is connected to the switching member 340 is positioned above a virtual line E on a straight line which connects the point A at which the elastic member 320 of the pedal effort controller 300 is installed at the pedal member 100 to the point C at which the bent portion of the switching member 340 contacts the height controller 140. In this case, the switching member 340 is configured to be pushed forward by the elastic force of the elastic member 320, but the pedal effort controller 300 contacts the height controller 140 and thus the upward movement thereof is limited to rotate downwardly along the bent shape, thereby pressing the protrusion 220 of the pedal arm 200. Therefore, the pedal arm 200 is applied with the returning force which causes the lower end thereof to rotate forward.

Figure 5:
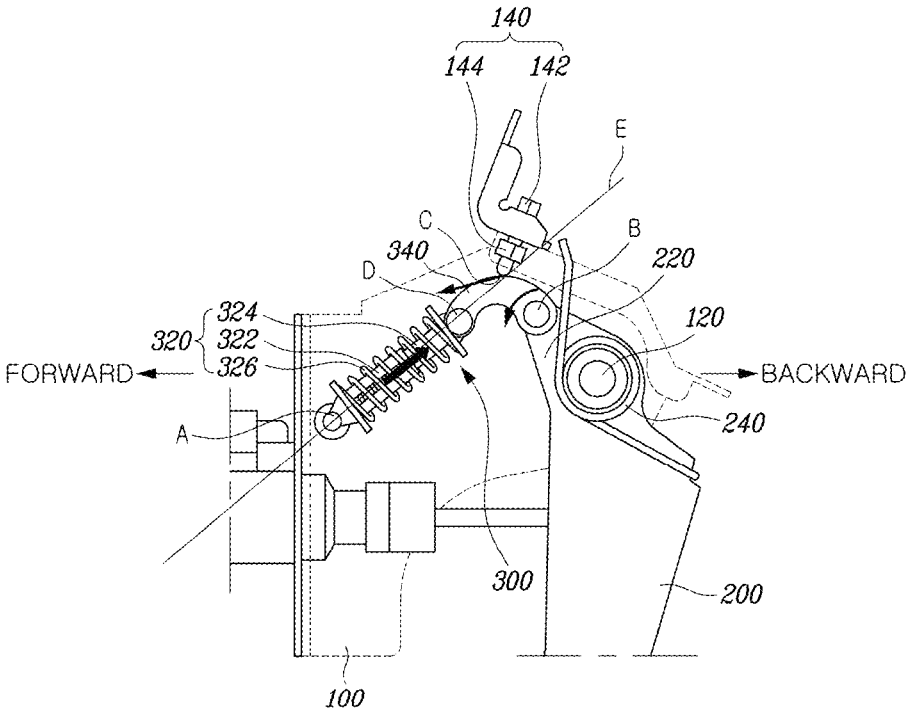

Here, as illustrated in FIG. 5, when the pedal arm 200 is stepped and thus rotates, the pedal effort controller 300 rotates with it, and as a result, the point D at which the elastic member 320 of the pedal effort controller 300 is connected to the switching member 340 is positioned above the virtual line E on a straight line which connects the point A at which the elastic member 320 of the pedal effort controller 300 is installed at the pedal member 100 to the point C at which the bent portion of the switching member 340 contacts the height controller 140. In this case, as the switching member 340 of the pedal effort controller 300 is supported by the height controller 140, the switching member 340 rotates forwardly to elastically press the elastic member 320.

Next, as illustrated in FIG. 6, when the pedal arm 200 is stepped by a predetermined amount or more and thus rotates, the point D at which the elastic member 320 of the pedal effort controller 300 is connected to the switching member 340 is positioned below the virtual line E on the straight line which connects the point A at which the elastic member 320 of the pedal effort controller 300 is installed at the pedal member 100 to the point C at which the bent portion of the switching member 340 contacts the height controller 140. Therefore, the switching member 340 of the pedal effort controller 300 heads for the front portion and is applied with the elastic force from the elastic member 320 to move forwardly, thereby applying the operating force pushing the protrusion 220 of the pedal arm 200 backwards. By doing so, as the upper end of the pedal arm 200 rotates backwards, the lower end rotates forward and the operating force is applied along with the stepping-on-force applied to the pedal arm 200, such that pedal effort may be reduced during operation of the pedal.

By doing so, it is possible to reduce a driver's fatigue during extended driving by reducing pedal effort, and to save manufacturing cost by simplifying structure.

Figure 7:
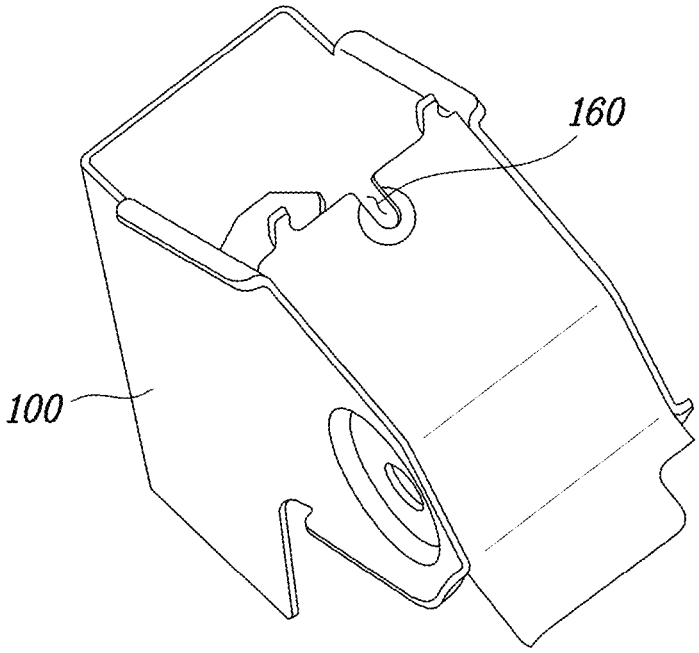
FIGS. 7 to 9 are diagrams illustrating an operation of the pedal operating apparatus of a vehicle of FIG. 1 at the time of a vehicle collision.
Figure 8:
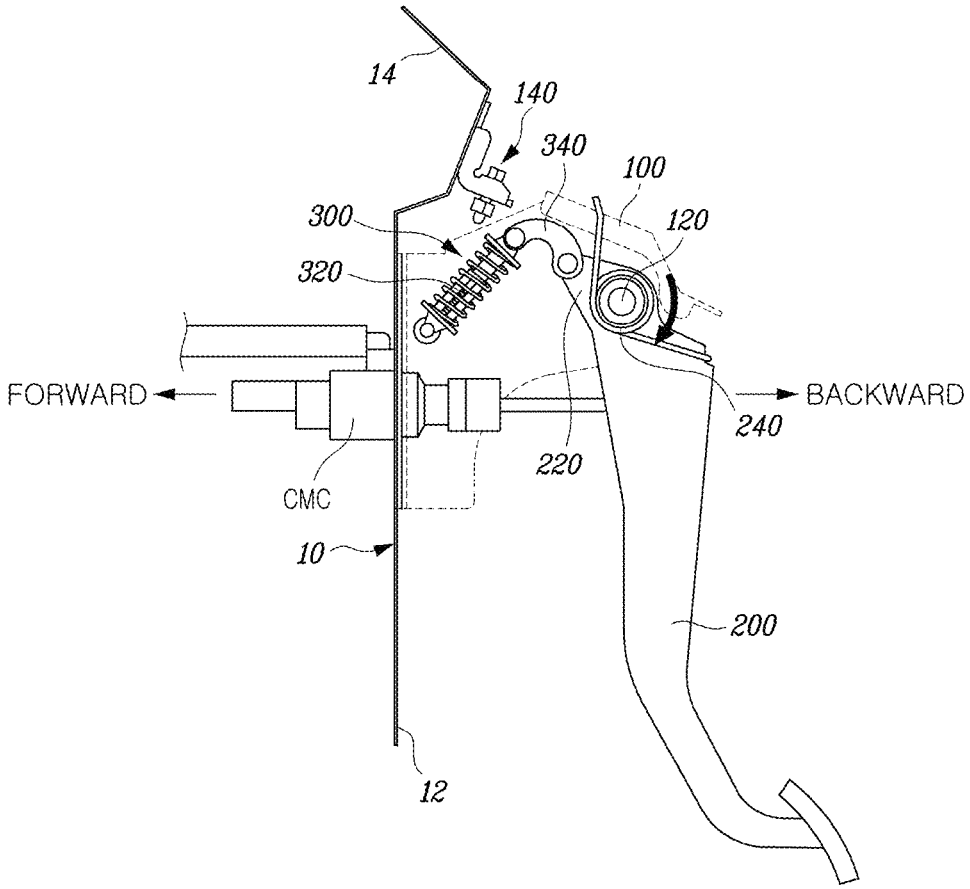
Figure 9:
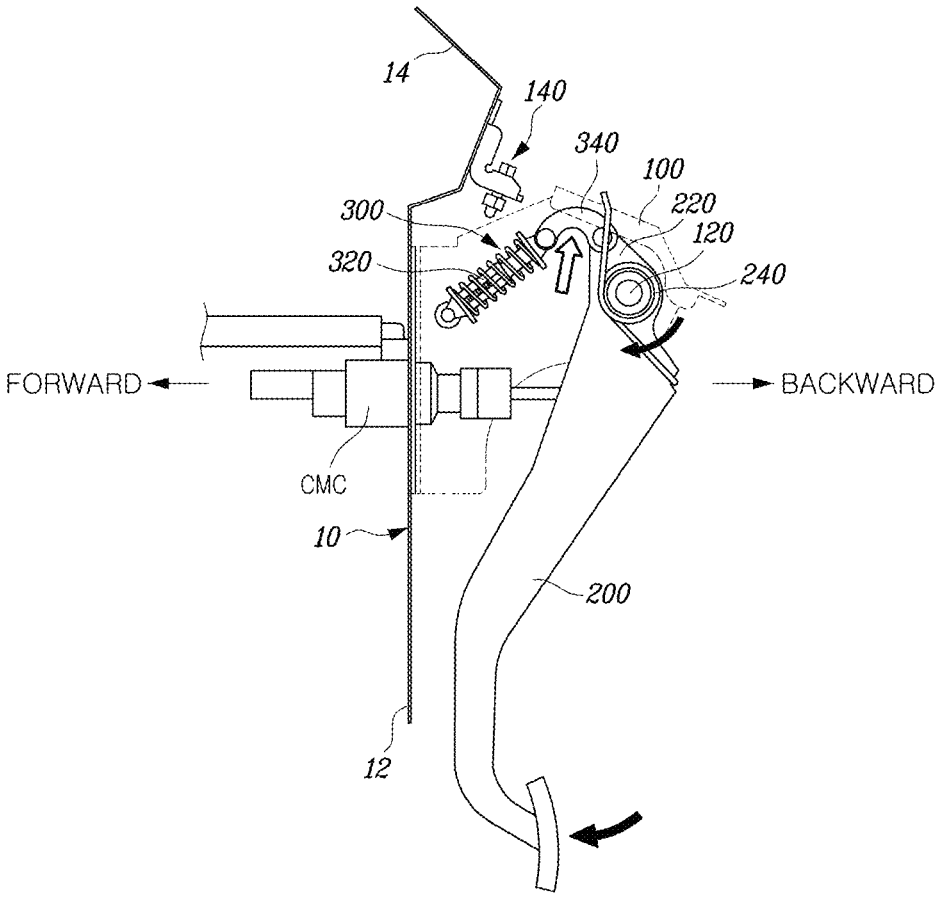

Meanwhile, as illustrated in FIG. 7, the upper end of the pedal member 100 is provided with an insertion groove 160 in which the height controller 140 is installed. The height controller 140 is coupled by penetrating the insertion groove 160 from the upper portion of the pedal member 100, and the lower end thereof extending downwardly after penetrating the insertion groove 160 may contact the switching member 340 of the pedal effort controller 300.

By doing so, the height controller 140 which is inserted into the insertion groove 160 in the pedal member 100, is configured to have the lower end contacting the switching member 340 of the pedal effort controller 300 to limit the upward movement of the switching member 340. The insertion groove 160 formed in the pedal member 100 may be formed to be positioned above the switching member 340, and the height controller 140 is installed so that the state in which the lower end contacts the switching member 340 is maintained to support the upward movement of the switching member 340. Thereby the height controller 140 smoothly rotates forwards or backwards along the bent shape.

The height controller 140 is configured of a bolting part 142 which is screw-coupled with the insertion groove 160 and a nut part 144 which fixes the bolting part 142 to the upper end of the pedal member 100, and the lower end of the bolting part 142 may contact the bent portion of the switching member 340.

By doing so, the height controller 140 is configured of the bolting part 142 and the nut part 144. As a result, the bolting part 142 is inserted into the insertion groove 160 of the pedal member 100 and then is fixed by the nut part 144, such that the height controller 140 may be firmly installed to the pedal member 100.

In particular, the bolting part 142 of the height controller 140 is screw-coupled with the insertion groove 160 of the pedal member 100, and thus the height of the bolting part 142 may be vertically controlled by screw rotation, thereby easily controlling pedal effort.

That is, when the position of the bolting part 142 is controlled downwardly in the pedal member 100, the switching member 340 is pressed downwardly and thus the elastic member 320 is elastically compressed. By doing so, as the elastic compression amount of the elastic member 320 is increased, the pedal arm 200 rotates and thus the force pushing the protrusion 220 is increased, such that the operating force is increased more, thereby more reducing the pedal effort.

However, when the position of the bolting part 142 is controlled upwardly in the pedal member 100, the switching member 340 moves upwardly and thus the elastically compression of the elastic member 320 is reduced. As a result, as the pedal arm 200 rotates, the operating force which allows the elastic member 320 to push the protrusion 220 is reduced, and thus reduction of pedal effort may be reduced.

As such, the height of the bolting part 142 of the height controller 140 is controlled in consideration of a driver's habit, pedal effort, and the like depending on pedal operation by the driver and thus reduction of pedal effort may be controlled. The height controller 140 is configured of the bolting part 142 and the nut part 144, and thus pedal effort may be easily controlled.

Meanwhile, as illustrated in FIG. 10, the lower end of the bolting part 142 is coupled with a pin member 142*a* which extends horizontally and thus may surface-contact the bent portion of the switching member 340.

By doing so, the lower end of the bolting part 142 contacts the switching member 340 of the pedal effort controller 300 through the pin-shaped pin member 142*a* which extends horizontally. As a result, the bolting part 142 surface-contacts the pedal effort controller 300 when the bolting part 142 contacts the pedal effort controller 300, such that damage to the bolting part 142 due to abrasion may be minimized. More preferably, the lower end of the bolting part 142 is applied with a rolling bearing and thus damage of the bolting part 142 due to abrasion is prevented, such that the bolting part 142 may be continuously used for a long period of time.

Meanwhile, as illustrated in FIG. 7, the insertion groove 160 of the pedal member 100 is formed to extend forwardly and thus the height control means 140 may be configured to be separated forwardly.

Further, the hinge shaft 120 of the pedal arm 200 may be provided with an elastic body 240 which has one end fixed to the pedal member 100 and the other end connected to the back end of the pedal arm 200 to impart elastic force so as to let the pedal arm 200 rotate forwardly.

This protects a driver's lower body from injury at a time of vehicle collision. Here, the insertion groove 160 of the pedal member 100 is formed to extend forwardly, and thus the height controller 140 may be separated through the insertion groove 160 at a time of vehicle collision, and thus the lower end of the pedal arm 200 rotates forwardly.

In addition, the pedal arm 200 is provided with the elastic body 240 and thus the lower end of the pedal arm 200 is imparted with the elastic force to head toward the front, such that driver injury due to the pedal arm 200 may be prevented.

Describing this now in detail, vehicle body panel 10 is configured of a dash panel 12 and a cowl panel 14 positioned thereon, the pedal member 100 is installed at the dash panel 12 in the vehicle body panel 10, and the height controller 140 is installed at the cowl panel 14 to be coupled with the insertion groove 160 of the pedal member 100.

Here, the vehicle body panel 10 is pushed backwards at the time of vehicle collision, and thus the pedal member 100 moves backwards. Generally, when a front collision of the vehicle occurs, the dash panel 12 in the vehicle body panel 10 has a larger pushing force than the cowl panel 14 positioned thereon, and therefore the pedal member 100 installed at the dash panel 12 is pushed backwards. In this case, when the height controller 140 is separated through the insertion groove 160 of the pedal member 100 in a state in which the height controller 140 installed at the cowl panel 14 supports the pedal effort controller 300, the pedal effort controller 300 moves upwardly in a region in which the height controller 140 is separated to remove the returning force applied to the pedal arm 200.

Additionally, since the elastic body 240 which is installed at the hinge shaft 120 of the pedal arm 200 imparts elastic force to let the lower end of the pedal arm 200 rotate forwardly, the pedal effort controller 300 moves to an empty region in which the height controller 140 is separated, and at the same time, the lower end of the pedal arm 200 rotates forwardly due to the elastic force of the elastic body 240. As a result, it is possible to prevent pain to the driver's foot due to the pedal arm 200.

The pedal illustrated in the drawings is the clutch pedal. Generally, in a clutch pedal, the pedal arm 200 is connected to a CMC, and a clutch hydraulic system is fractured at the time of vehicle collision. Thus, the force that would push the pedal backwardly through the CMC is removed, such that the lower end of the pedal arm 200 may smoothly rotate.

According to the exemplary embodiments of the present invention, the pedal operating apparatus of a vehicle having the foregoing structure reduces the pedal effort when he/she operates the pedal to reduce the driver's fatigue against pedal operation of the driver. By doing so, it is possible to reduce driver's fatigue during long time driving by reducing pedal effort, and save manufacturing costs by simplifying structure.

Further, it is possible to prevent pain to a driver's lower body by letting the pedal arm 200 rotate forwardly at the time of a vehicle collision.

Although the present invention has been shown and described with respect to specific exemplary embodiments, it will be obvious to those skilled in the art that the present invention may be variously modified and altered without departing from the spirit and scope of the present invention as defined by the following claims.

What is claimed is:

1. A pedal operating apparatus for a vehicle, comprising:

a pedal member configured to be fixed to a vehicle body panel, have a hinge shaft provided at a back end thereof, and be provided with a height controller above the hinge shaft;

a pedal arm configured with an upper end rotatably installed at the hinge shaft of the pedal member, the upper end being provided with a protrusion protruding forward; and a pedal effort controller configured with an elastic member rotatably installed at a front portion of the pedal arm in the pedal member and having a length elastically changeable, and a switching member extending and bent downwardly from the elastic member to be connected to the protrusion of the pedal arm and having a bent portion contacting the height controller to be supported thereby, the pedal effort controller pressing the protrusion downwardly through the switching member by elastic force of the elastic member at an initial position of the pedal arm and pushing the protrusion upward by rotating along with the protrusion when the pedal arm is rotating.

2. The pedal operating apparatus of a vehicle of claim 1, wherein the protrusion of the pedal arm protrudes upward forwardly based on the hinge shaft.

3. The pedal operating apparatus of a vehicle of claim 1, wherein an upper end of the pedal member is provided with an insertion groove in which the height controller is installed, the height controller being coupled by penetrating the insertion groove from an upper portion of the pedal member, and a lower end thereof extending downwardly after penetrating the insertion groove contacts the switching member of the pedal effort controller.

4. The pedal operating apparatus of a vehicle of claim 3, wherein the height controller is configured with a bolting part which is screw-coupled with the insertion groove and a nut part which fixes the bolting part to the upper end of the pedal member and a lower end of the bolting part contacts the bent portion of the switching member.

5. The pedal operating apparatus of a vehicle of claim 4, wherein the lower end of the bolting part is coupled with a pin member which extends horizontally and surface-contacts the bent portion of the switching member.

6. The pedal operating apparatus of a vehicle of claim 3, wherein the insertion groove of the pedal member is formed to extend forwardly such that the height controller is separated forwardly.

7. The pedal operating apparatus of a vehicle of claim 3, wherein the vehicle body panel is configured with a dash panel and a cowl panel positioned thereon, the pedal member is at the dash panel in the vehicle body panel, and the height controller is at the cowl panel to be coupled with the insertion groove of the pedal member.

8. The pedal operating apparatus of a vehicle of claim 1, wherein the hinge shaft of the pedal arm is provided with an elastic body which has one end fixed to the pedal member and another end connected to a back end of the pedal arm to impart elastic force to enable the pedal arm to rotate forwardly.

9. The pedal operating apparatus of a vehicle of claim 1, wherein the elastic member of the pedal effort controller is configured to include a first extension rotatably installed to the pedal member and a second extension which elastically moves when inserted into the first extension, and the switching member is rotatably connected to the second extension and extends to be bent downwardly in an arc shape and then is rotatably connected to the protrusion of the pedal arm.

10. The pedal operating apparatus of a vehicle of claim 9, wherein the first extension is formed of a cylinder, the second extension is formed of a rod moving with being inserted into the cylinder, and an elastic spring is provided to enclose the first extension and the second extension to elastically move the second extension.

11. The pedal operating apparatus of a vehicle of claim 1, wherein as the elastic member is positioned below the hinge shaft of the pedal arm in the pedal member and the switching member is connected to the protrusion of the pedal arm, the pedal effort controller is positioned above the hinge shaft.

* * * * *